US009038773B2

(12) United States Patent
Banter

(10) Patent No.: US 9,038,773 B2
(45) Date of Patent: May 26, 2015

(54) ACOUSTIC COVER ASSEMBLY

(75) Inventor: Chad Banter, Lincoln University, PA (US)

(73) Assignee: W. L. Gore & Associates, Inc., Newark, DE (US)

( * ) Notice: Subject to any disclaimer, the term of this patent is extended or adjusted under 35 U.S.C. 154(b) by 40 days.

(21) Appl. No.: 13/589,711

(22) Filed: Aug. 20, 2012

(65) Prior Publication Data

US 2014/0048351 A1 Feb. 20, 2014

(51) Int. Cl.

| | |
|---|---|
| ***E04B 1/82*** | (2006.01) |
| ***G10K 11/00*** | (2006.01) |
| ***G10K 11/18*** | (2006.01) |
| ***H04R 1/02*** | (2006.01) |
| ***H04R 1/08*** | (2006.01) |
| *H04R 25/00* | (2006.01) |

(52) U.S. Cl.

CPC ..... *G10K 11/002* (2013.01); *Y10T 156/10* (2015.01); *G10K 11/18* (2013.01); *H04R 1/023* (2013.01); *H04R 1/086* (2013.01); *H04R 25/654* (2013.01)

(58) Field of Classification Search

CPC ..... E04B 1/82
USPC ..... 181/286
See application file for complete search history.

(56) References Cited

U.S. PATENT DOCUMENTS

| | | | | |
|---|---|---|---|---|
| 3,953,566 | A | 4/1976 | Gore | |
| 4,013,810 | A * | 3/1977 | Long | 428/313.9 |
| 4,110,392 | A | 8/1978 | Yamazaki | |
| 4,187,930 | A | 2/1980 | James | |
| 5,146,047 | A * | 9/1992 | Nagata et al. | 174/388 |
| 5,183,545 | A | 2/1993 | Branca et al. | |
| 5,476,589 | A | 12/1995 | Bacino | |
| 5,536,910 | A * | 7/1996 | Harrold et al. | 181/290 |
| 5,581,019 | A * | 12/1996 | Minor et al. | 73/114.77 |
| 5,828,012 | A * | 10/1998 | Repolle et al. | 181/175 |
| 5,916,671 | A | 6/1999 | Dauber et al. | |
| 6,512,834 | B1 * | 1/2003 | Banter et al. | 381/386 |
| 6,932,187 | B2 | 8/2005 | Banter et al. | |
| 7,095,864 | B1 | 8/2006 | Billson et al. | |
| 7,249,653 | B2 * | 7/2007 | Sheng et al. | 181/290 |
| 7,306,729 | B2 * | 12/2007 | Bacino et al. | 210/500.22 |
| 8,157,048 | B2 * | 4/2012 | Banter et al. | 181/198 |
| 8,172,035 | B2 * | 5/2012 | Fehervari et al. | 181/167 |
| 8,443,934 | B2 * | 5/2013 | Akino | 181/290 |
| 2005/0077102 | A1 * | 4/2005 | Banter et al. | 181/149 |
| 2010/0247857 | A1 | 9/2010 | Sanami et al. | |
| 2010/0270102 | A1 | 10/2010 | Banter et al. | |

FOREIGN PATENT DOCUMENTS

| | | |
|---|---|---|
| EP | 0 730 017 | 4/1996 |
| JP | 10-165787 | 6/1998 |

OTHER PUBLICATIONS

International Search Report for PCT/US2013/054269 dated Nov. 26, 2014.

* cited by examiner

*Primary Examiner* — Forrest M Phillips
(74) *Attorney, Agent, or Firm* — Amy L. Miller

(57) ABSTRACT

An acoustic protective cover assembly comprising a porous membrane and an acoustic gasket is disclosed. The porous membrane is bonded to the acoustic gasket at a peripheral region, the membrane is left unhanded at a central region. The acoustic gasket comprises a composite of a porous polytetrafluoroethylene (PTFE) polymer matrix of polymeric nodes interconnected by fibrils, resilient expandable microspheres embedded within the matrix.

15 Claims, 7 Drawing Sheets

ACOUSTIC COVER ASSEMBLY

BACKGROUND OF THE INVENTION

Electronic devices like cellular phones, tablets, computers, radios, bar code scanners and hearing aids may have at least one acoustic transducer to convert electrical signals into sound or vice-versa. Acoustic transducers such as loudspeakers, microphones, ringers, buzzers, etc. are placed in a protective housing with one or more small apertures which enable sound transmission and reception. These apertures are typically covered with an acoustic cover assembly to protect the transducer from particulate and or liquid contaminants present in the ambient environment. To preserve acoustic performance of transducers, such acoustic covers must provide minimal sound attenuation.

Acoustic cover assemblies may include cover materials such as micro-porous membranes, non-porous films and porous fabrics including both woven and non-woven materials. These cover materials are usually used in conjunction with a gasket which serves to seal and focus acoustic energy to the apertures and prevent any sound leakage.

Known acoustic protective cover assemblies are described in U.S. Pat. No. 6,932,187, U.S. Pat. No. 6,512,834, U.S. Pat. No. 5,828,012 and US 2010/0270102. In use, the gasket in an acoustic cover assembly may be compressed to about 50% of its original thickness when installed in an electronic device. Compression of the gasket facilitates a good seal between the assembly and the components of the device. However, gasket compression may effect the cover material tension, which may in turn alter the acoustic performance. If a cover material has higher tension as a result of gasket compression, it can cause sound waves to reflect off the cover material. The effect would be a higher acoustic insertion loss for the cover material, ultimately degrading the frequency response of the acoustic system.

Therefore, there still exists a need to provide an improved acoustic cover assembly which has minimal acoustic insertion loss under compression while offering a high level of protection from external contaminants.

SUMMARY

In a first embodiment, the invention provides an acoustic protective cover assembly having an acoustic gasket comprising a composite of a porous expanded polytetrafluoroethylene (PTFE) polymer matrix having polymeric nodes interconnected by fibrils and resilient expandable microspheres within the matrix, and a cover material bonded to said acoustic gasket at a peripheral region of the cover and unbonded at a central region of the cover. In such an embodiment, the invention may provide a cover material comprising a membrane, such as porous expanded PTFE. The acoustic cover assembly material may be oleophobic. The cover material may be any non-porous film, woven fabric or non-woven materials. The acoustic gasket may include an elastomer, such as silicone disposed within the matrix.

In another embodiment, the invention may provide an acoustic device having an acoustic transducer, an aperture for the passage of acoustic energy and an acoustic cover assembly covering the aperture in which the acoustic cover assembly includes an acoustic gasket surrounding the aperture, wherein the gasket is a composite of a porous expanded polytetrafluoroethylene (PTFE) polymer matrix of polymeric nodes interconnected by fibrils and resilient expandable microspheres within the matrix and a cover material bonded to said acoustic gasket and covering the aperture.

The invention also includes a method of covering an aperture of an acoustic device, including the steps of surrounding the aperture with an acoustic gasket that is a composite of a porous expanded polytetrafluoroethylene (PTFE) polymer matrix of nodes interconnected by fibrils and resilient expandable microspheres within the matrix, and bonding a cover material to the acoustic gasket wherein the cover material covers the aperture.

DETAILED DESCRIPTION OF THE INVENTION

Figure 1:
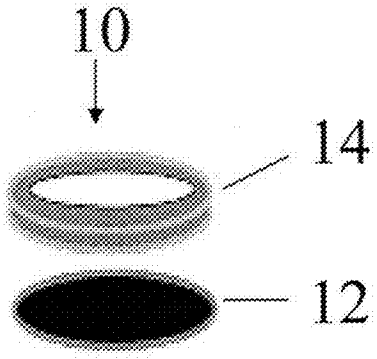
FIG. 1 shows an acoustic cover assembly.

As shown in exploded view of FIG. 1, an acoustic cover assembly (10) comprises two key components, the cover material (12) and an acoustic gasket (14). In use the gasket (14) of the assembly may be compressed to about 50% of its original thickness when installed in an electronic device. This compression facilitates a good seal between the assembly and the components of the device.

Several materials may be used as the cover material (12) including porous PTFE membranes, porous materials constructed out of natural or synthetic fibers formed into woven or non-woven webs or knits, perforated metal foils and in some cases non-porous films such as Mylar®. Expanded PTFE membranes described in U.S. Pat. No. 7,306,729, U.S. Pat. No. 3,953,566, U.S. Pat. No. 5,476,589 and U.S. Pat. No. 5,183,545 may be preferred. The cover material may be rendered oleophobic using methods known in the art.

Acoustic gaskets may be constructed of soft elastomeric materials such as silicone rubber and silicone rubber foam. Other suitable materials for acoustic gaskets include polyurethane cellular foams and PTFE gaskets such as those described in U.S. Pat. No. 4,110,392, U.S. Pat. No. 3,953,566, U.S. Pat. No. 4,187,930. As described therein the materials may include a matrix of porous PTFE partially filled with elastomers as well as metal-plated or particle filled polymers which may provide electrical conductivity where desired.

Expandable thermoplastic microspheres are monocellular particles comprising a body of resinous materials encapsulating a volatile fluid. When heated, the resinous material of the thermoplastic microsphere softens and the volatile material expands, causing the entire microsphere to increase substantially in size. On cooling, the resinous material in the shell of the microspheres ceases flowing and tends to retain its enlarged dimension; the volatile fluid inside the microsphere tends to condense, causing a reduced pressure in the microsphere.

Such thermoplastic microspheres are commercially available from Nobel Industries, Sweden under the trademark EXPANCEL®. These microspheres may be obtained in a variety of sizes and forms, with expansion temperatures generally ranging from 80 to 130 degrees Celsius.

The acoustic gasket of the present invention comprises a composite of a porous polytetrafluoroethylene (PTFE) polymer matrix having polymeric nodes interconnected by fibrils and resilient expandable microspheres embedded within the nodes and fibrils.

A gasket material may be prepared by mixing a dry preparation of resilient expandable microspheres with a dispersion of PTFE or a similar polymer and then heating the resulting composition. Upon heating, the polymer mixture may expand in three dimensions to achieve a porous network of polymeric nodes and fibrils. Such a gasket material may be prepared according to the teachings of U.S. Pat. No. 5,916,671.

A mixture of PTFE in the form of paste, dispersion or powder and microspheres in the form of dry powder or solution are mixed in proportions of 1 to 90% by weight microspheres, with 5 to 85% by weight of microspheres being preferred. It should be appreciated that a wide range of products may be created even with a percentage of microspheres of merely 0.5 to 5% by weight; Mixture may occur by any suitable means, including dry blending of powders, wet blending, co-coagulation of aqueous dispersions and slurry filler, high shear mixing, etc.

In an embodiment containing 10% EXPANCEL and 90% PTFE by weight was prepared. Once mixed, preferably the resulting composition is heated to a temperature of 80 to 180 degrees Celsius for a period of 10 minutes to activate the microspheres. If further density reduction is desired, the composition may be re-heated to a temperature of 40 to 240 degrees Celsius and mechanically expanded through any conventional means, such as those disclosed in U.S. Pat. No. 3,963,566 to Gore. In fact, this material lends itself to use with a variety of mechanical expansion techniques whether before, during and/or after microsphere expansion.

Figure 7:
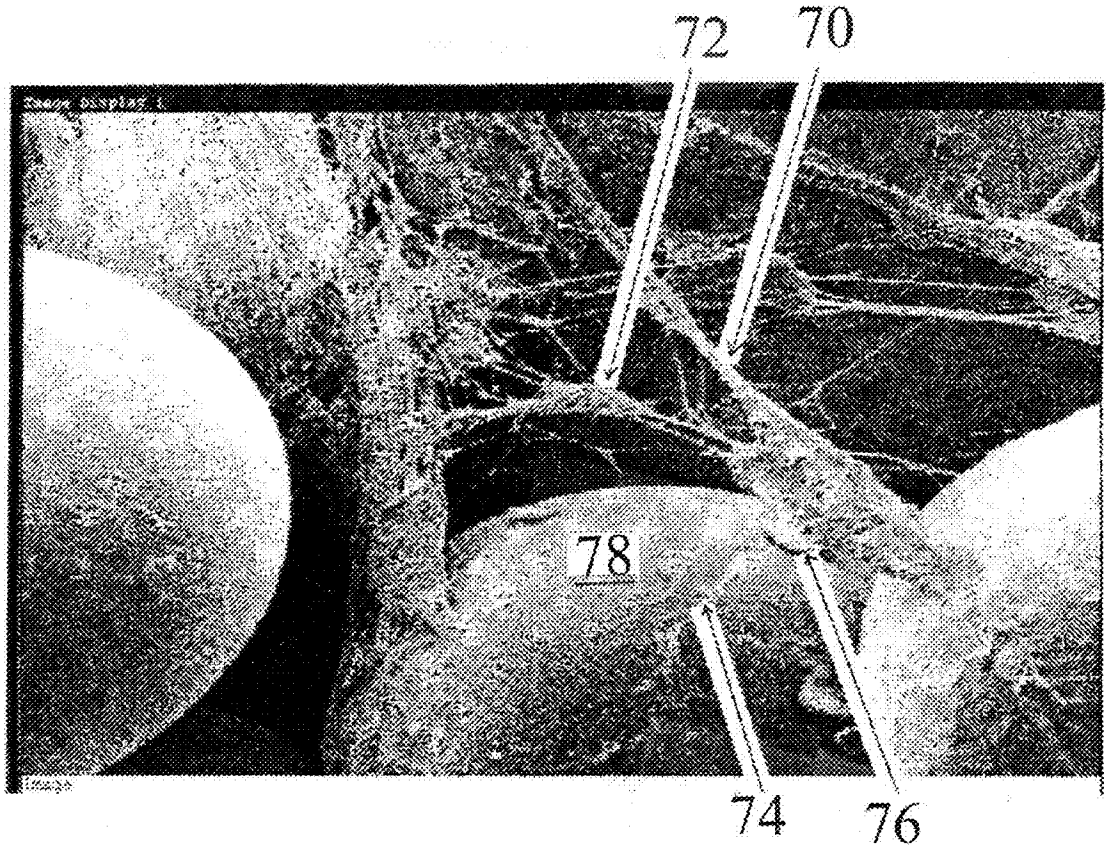
FIG. 7 shows an SEM image of an embodiment of the gasket comprising PTFE and expandable thermoplastic spheres, enlarged 1280 times.

As shown in FIG. 7, the microspheres 78 can be seen attached to and embedded within fibrils 70 and nodes 72. As is shown, the polymer actually becomes attached to the microspheres, apparently with some fibrils 74 extending directly from the microspheres 78 and some nodes 76 attached directly to the surface of the microspheres 78.

Surprisingly, it was found that the acoustic cover assembly constructed using such a gasket material and a porous expanded PTFE membrane as the cover material had very low acoustic impact. In an embodiment with exposed cover material area of about 7 $mm^2$ or less, the acoustic insertion loss of the assembly was measured to be less than 6 dB at about 50% gasket compression.

Optionally, an elastomer such as Silicone may be disposed within the porosity of the gasket material to provide improved water protection. Methods of constructing such a gasket material are described in EP 0730017. The gasket material comprising porous polytetrafluoroethylene (PTFE) polymer matrix having polymeric nodes interconnected by fibrils and resilient expandable microspheres embedded within the nodes and fibrils may be partially of fully imbibed with a silicone elastomer material.

Figure 2:
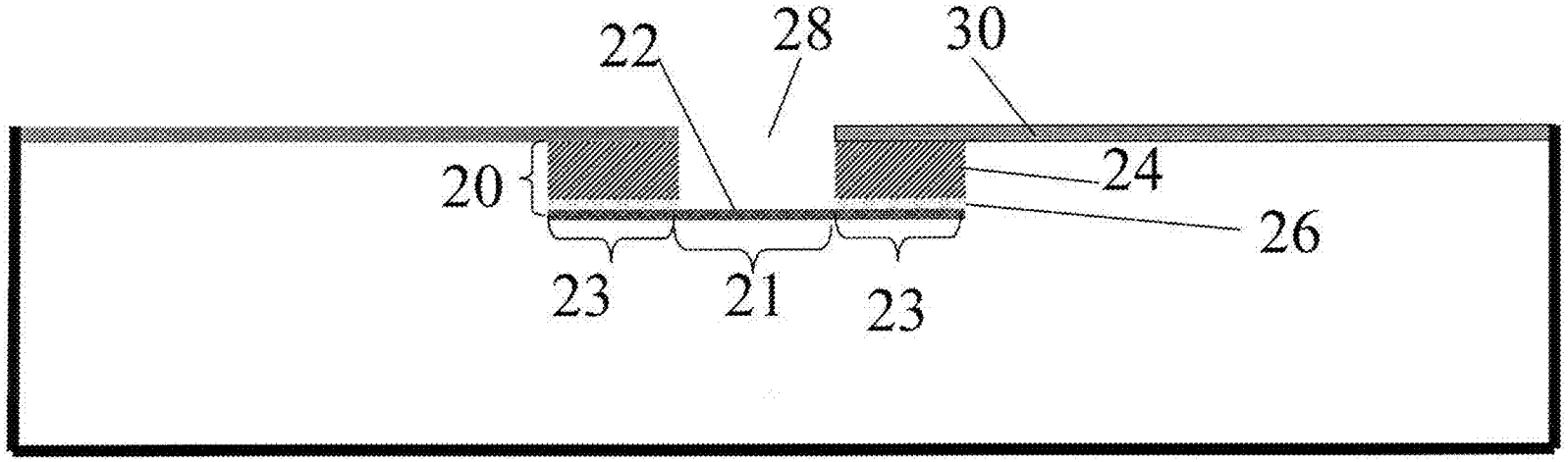
FIG. 2 depicts one embodiment of the acoustic cover assembly installed in an electronic device.

The cover material and the gasket may be attached together using known methods in the art including the use of an adhesive. FIG. 2 shows an acoustic cover assembly (20) comprising a micro-porous membrane cover material (22) and an acoustic gasket (24), attached together using a double sided pressure sensitive adhesive (26). The gasket is attached at a peripheral region (23) of the cover material. The gasket is open in a central region (21) and the cover material is unbonded at the central region (21) the assembly (20) covers an aperture (28) of the protective housing (30) in which an acoustic transducer (not shown) is placed. In the configuration shown in FIG. 2, the compression of the gasket provides a seal against liquid water between the housing and the gasket.

Figure 3:
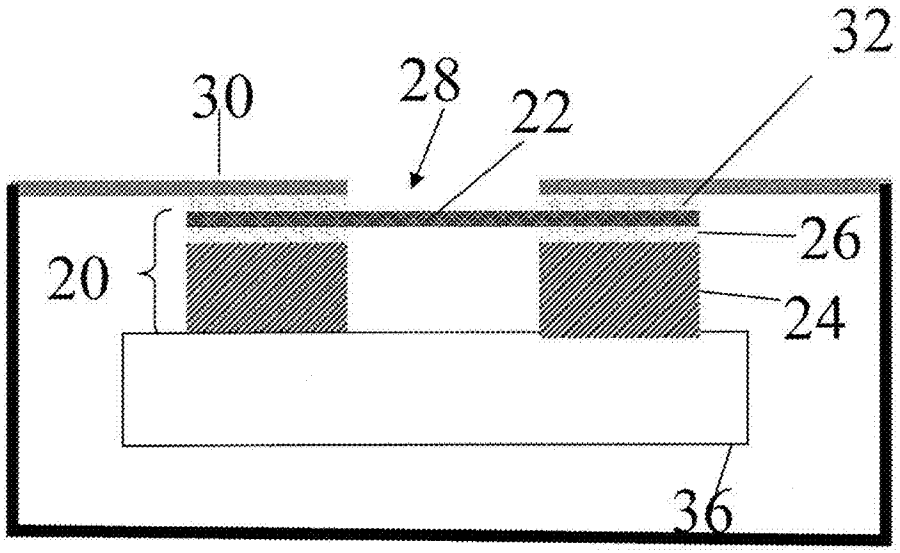
FIG. 3 shows another embodiment of the acoustic cover assembly installed in an electronic device.

FIG. 3 shows another configuration in which the compression of the gasket (24) provides an acoustic seal between the gasket (24) and the transducer (36), thereby preventing acoustic leakage which can reduce overall output sound pressure level and the acoustic frequency response. The assembly (20) is attached to the protective housing (30) by means of an adhesive (32)

Acoustic Frequency Response Measurement Method

This test method was used to measure the acoustic frequency response of the acoustic cover assembly under two conditions. In the first condition, the gasket is uncompressed, in the second it is compressed 50%.

Figure 4:
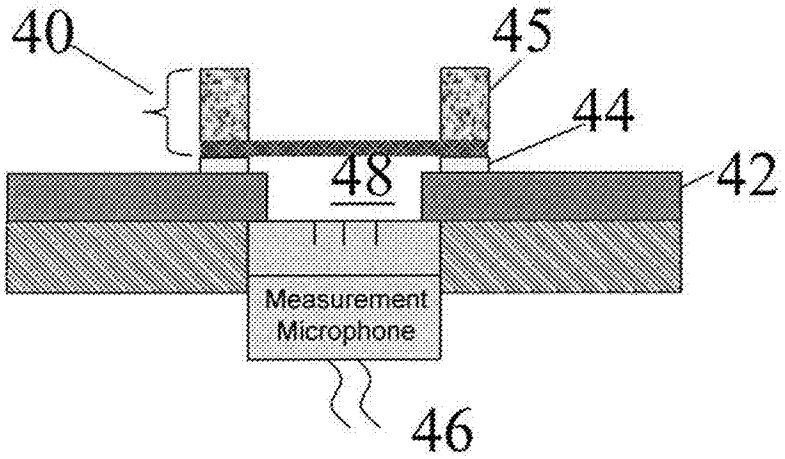
FIG. 4 shows an embodiment of the acoustic cover assembly having the gasket in an uncompressed state during the acoustic frequency response measurement test

As shown in FIG. 4, the acoustic frequency response of the acoustic cover assembly (40) was evaluated when the gasket (45) of the assembly was in an uncompressed state. A sample of the assembly (40) was placed over a 2 mm ID hole (48) on an acrylic plate (42) by means of an adhesive (44). The sample was placed inside a B&K type 4232 anechoic test box at a distance of 10 cm from an internal driver or speaker. The speaker was excited with an external stimulus at the nominally 1 Pa of sound pressure (94 dB SPL) over the frequency range from 100 Hz to 10 kHz. The acoustic response was measured with a B&K type 4939 measurement microphone (46) and was reported as $R_{uncompressed}$.

Figure 5:
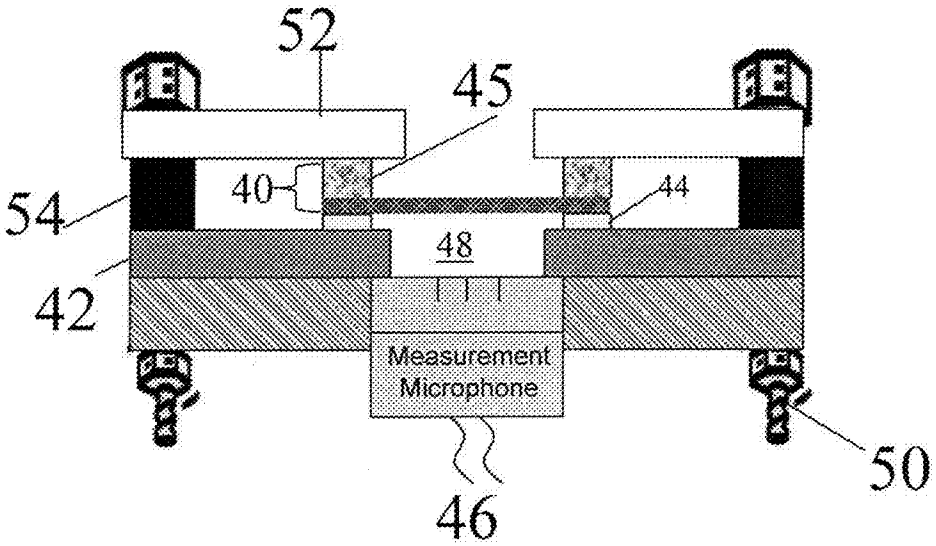
FIG. 5 shows an embodiment having the gasket of the acoustic cover assembly in a compressed state during the acoustic frequency response measurement test.

FIG. 5 depicts the condition in which the gasket (45) of the acoustic cover assembly (40) is under 50% compression. This was achieved by using fastening screws (50) and an Aluminum plate (52) such that the overall height of the assembly was reduced by 50%. Compression stops (54) were adjusted to ensure consistent compression of the sample. The acoustic frequency response was then measured using the same stimulus level and by using measurement microphone (46) as described above and was reported as $R_{compressed}$ The acoustic impact was measured in terms of compression loss (in dB) and defined by the following equation:

$$\text{Compression Loss (dB)}=R_{uncompressed}-R_{compressed}$$

Water Seal Efficacy Test Method

Figure 6:
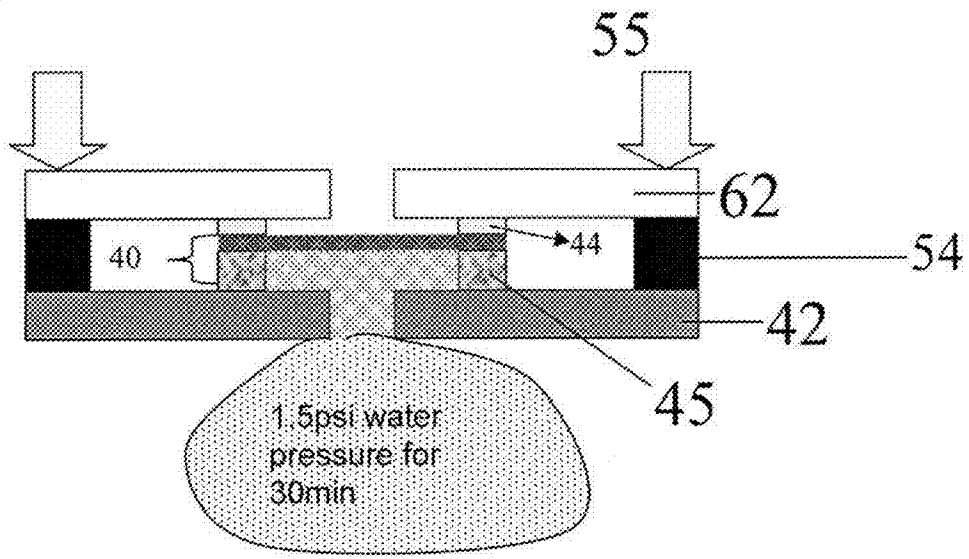
FIG. 6 depicts schematically the water seal efficacy test method.

This test method was used to measure the efficacy of the gasket's seal against liquid water. As shown in FIG. 6, the acoustic cover assembly (40) was placed between a top acrylic plate (62) and a bottom acrylic plate (42). The assembly was attached to the top plate (62) using a double-sided adhesive (44). The gasket (45) was maintained at about 50% compression by means of using a compression stop (54) and applying a pneumatic load (55). The assembly was subjected to a water pressure of 1.5 psi for 30 mins. The test result was reported as "Pass" if no water leakage was observed and as "Fail" if water leakage was observed escaping from either the gasket or PTFE membrane. A "Pass" according to this test method indicates the gasket's high efficacy as a seal against liquid water in combination with a PTFE membrane.

Example 1

A porous expanded PTFE membrane (Part Number GAW 325 from W.L. Gore & Associates, Inc) was cut into a disk, 6 mm in diameter. A ring of gasket material (Part Number 10652331, W.L. Gore & Associates, Inc) of width 1.5 mm and outer diameter 6 mm was attached to the expanded PTFE membrane by using a double sided adhesive. This resultant acoustic cover assembly had exposed membrane area of about 7 $mm^2$. The acoustic frequency response of the assembly was measured using the Acoustic Frequency Response Measurement Test Method. The compression loss was calculated to be 5 dB. The assembly also passed the Water Seal Efficacy Test.

Comparative Example 1

A porous expanded PTFE membrane (Part Number GAW 325 from WI. Gore & Associates, Inc) was cut into a disk, 6 mm in diameter. A ring of gasket material (Product LS2503 Cellular Urethane, EAR Aearo Technologies, a 3M Company) of width 1.5 mm and outer diameter 6 mm was attached to the expanded PTFE membrane by using a double sided adhesive. This resultant acoustic cover assembly had exposed membrane area of about 7 $mm^2$. This acoustic frequency response of the assembly was measured using the Acoustic Frequency Response Measurement Test Method. The compression loss was calculated to be as high as 9.5 dB.

While particular embodiments of the present invention have been illustrated and described herein, the present invention should not be limited to such illustrations and descriptions. It should be apparent the changes and modifications may be incorporated and embodied as part of the present invention within the scope of the following claims.

I claim:

1. An acoustic protective cover assembly comprising:

a. an acoustic gasket comprising a composite of a porous expanded polytetrafluoroethylene (PTFE) polymer matrix having polymeric nodes interconnected by fibrils and resilient expandable microspheres within the matrix, and b. cover material bonded to said acoustic gasket at a peripheral region of the cover and unbonded at a central region of the cover.

2. The acoustic cover assembly of claim 1 wherein the cover material comprises a membrane.

3. The acoustic cover assembly of claim 2 wherein the cover material comprises porous expanded PTFE.

4. The acoustic cover assembly of claim 1 wherein the cover material is oleophobic.

5. The acoustic cover assembly of claim 1 wherein the cover material is selected from the group consisting of non-porous films, woven fabrics and non-woven materials.

6. The acoustic protective cover assembly of claim 1, wherein the acoustic gasket further comprises an elastomer disposed within the matrix.

7. The acoustic protective cover assembly of claim 6 in which the elastomer comprises silicone.

8. The acoustic protective cover assembly of claim 1 in which the gasket material and cover material are bonded together with a double-sided pressure sensitive adhesive at the perimeter of the cover material.

9. An acoustic protective cover assembly comprising:

a. an acoustic gasket consisting of:

i. a porous polytetrafluoroethylene (PTFE) polymer matrix having polymeric nodes interconnected by fibrils, ii. resilient expandable microspheres embedded within the matrix, and iii. elastomer disposed within the matrix b. a cover material adjacent to the acoustic gasket such that the gasket contacts a peripheral portion of the cover material.

10. An acoustic device having an acoustic transducer, an aperture for the passage of acoustic energy and an acoustic cover assembly covering the aperture, the acoustic cover assembly comprising:

a. an acoustic gasket surrounding the aperture, the gasket comprising a composite of a porous expanded polytetrafluoroethylene (PTFE) polymer matrix of polymeric nodes interconnected by fibrils and resilient expandable microspheres within the matrix and b. a cover material bonded to said acoustic gasket and covering the aperture.

11. A method of covering an aperture of an acoustic device comprising a. surrounding the aperture with an acoustic gasket, the acoustic gasket comprising a composite of a porous expanded polytetrafluoroethylene (PTFE) polymer matrix of nodes interconnected by fibrils and resilient expandable microspheres within the matrix, and b. bonding a cover material to the acoustic gasket wherein the cover material covers the aperture.

12. The acoustic protective cover assembly of claim 1, wherein each of the resilient expandable microspheres comprises a body of resinous materials encapsulating a volatile fluid.

13. The acoustic protective cover assembly of claim 9, wherein each of the resilient expandable microspheres comprises a body of resinous materials encapsulating a volatile fluid.

14. The acoustic device of claim 10, wherein each of the resilient expandable microspheres comprises a body of resinous materials encapsulating a volatile fluid.

15. The method of claim 11, wherein each of the resilient expandable microspheres comprises a body of resinous materials encapsulating a volatile fluid.

* * * * *

UNITED STATES PATENT AND TRADEMARK OFFICE

CERTIFICATE OF CORRECTION

PATENT NO. : 9,038,773 B2
APPLICATION NO. : 13/589711
DATED : May 26, 2015
INVENTOR(S) : Chad Banter It is certified that error appears in the above-identified patent and that said Letters Patent is hereby corrected as shown below:

On the Title page, at item (57) ABSTRACT, line 4, change "the membrane is left handed at a central region." to "the membrane is left unbonded at a central region.".

In the Specification

At column 3, line 57, change "fibrils may be partially of fully imbibed with a" to "fibrils may be partially or fully imbibed with a".

At column 3, beginning at line 65 to column 4, line 2, change "The gasket is open in a central region (21) and the cover material is unbonded at the central region (21) the assembly (20) covers an aperture (28) of the protective housing (30) in which an acoustic transducer (not shown) is placed." to "The gasket is open in a central region (21) and the cover material is unbonded at the central region (21). The assembly (20) covers an aperture (28) of the protective housing (30) in which an acoustic transducer (not shown) is placed.".

Signed and Sealed this
Tenth Day of November, 2015

Michelle K. Lee

Michelle K. Lee
*Director of the United States Patent and Trademark Office*